US012474096B2

(12) United States Patent
Ishii

(10) Patent No.: US 12,474,096 B2
(45) Date of Patent: Nov. 18, 2025

(54) REFRIGERATION CYCLE DEVICE

(71) Applicant: Mitsubishi Electric Corporation, Tokyo (JP)

(72) Inventor: Hinoki Ishii, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 128 days.

(21) Appl. No.: 18/257,011

(22) PCT Filed: Mar. 3, 2021

(86) PCT No.: PCT/JP2021/008056
§ 371 (c)(1),
(2) Date: Jun. 12, 2023

(87) PCT Pub. No.: WO2022/185427
PCT Pub. Date: Sep. 9, 2022

(65) Prior Publication Data
US 2024/0044554 A1 Feb. 8, 2024

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC ..... F25B 41/20; F25B 41/33; F25B 13/00; F25B 2500/07; F25B 2500/08
See application file for complete search history.

(56) References Cited

U.S. PATENT DOCUMENTS

2014/0305144 A1* 10/2014 Kim ..... F25B 41/20 62/79
2015/0300701 A1 10/2015 Nakaguchi et al.
2016/0068047 A1 3/2016 Kobayashi et al.
2017/0151856 A1 6/2017 Kuwahara
2019/0376731 A1* 12/2019 Iwata ..... F25B 9/002
(Continued)

FOREIGN PATENT DOCUMENTS

JP H05-296579 A 11/1993
JP 2015-206553 A 11/2015
JP 2018-044686 A 3/2018
(Continued)

OTHER PUBLICATIONS

English translation of Yamaguchi et al. (WO-2021044548-A1). (Year: 2021).*
(Continued)

*Primary Examiner* — Miguel A Diaz
(74) *Attorney, Agent, or Firm* — POSZ LAW GROUP, PLC

(57) ABSTRACT

One aspect of a refrigeration cycle device of the present disclosure includes a first refrigerant circuit in which a compressor, a condenser, an internal heat exchanger, a first pressure-reducing device, and an evaporator are annularly connected; a second refrigerant circuit configured to branch from a branch portion of the first refrigerant circuit and merge with a merging portion of the first refrigerant circuit on a suction side of the compressor via the internal heat exchanger; and a pressure release means provided between the branch portion and the internal heat exchanger in the second refrigerant circuit.

10 Claims, 8 Drawing Sheets

(56) References Cited

U.S. PATENT DOCUMENTS

| | | | | |
|---|---|---|---|---|
| 2021/0148620 | A1* | 5/2021 | Yamada | F25B 13/00 |
| 2022/0136741 | A1 | 5/2022 | Nakajima et al. | |

FOREIGN PATENT DOCUMENTS

| | | | | |
|---|---|---|---|---|
| JP | 6291333 | B | 3/2018 | |
| WO | 2014/171107 | A1 | 10/2014 | |
| WO | 2015/198559 | A1 | 12/2015 | |
| WO | 2019/027050 | A1 | 2/2019 | |
| WO | 2020/202553 | A1 | 10/2020 | |
| WO | WO-2021044548 | A1 * | 3/2021 | F25B 13/00 |

OTHER PUBLICATIONS

Office Action dated Aug. 1, 2023 issued in corresponding JP patent application No. 2023-503583 (and English Translation).

International Search Report of the International Searching Authority mailed Apr. 13, 2021 in corresponding International Application No. PCT/JP2021/008056 (and English translation).

* cited by examiner

REFRIGERATION CYCLE DEVICE

CROSS REFERENCE TO RELATED APPLICATION

This application is a U.S. national stage application of International Application No. PCT/JP2021/008056, filed on Mar. 3, 2021, the contents of which are incorporated herein by reference.

TECHNICAL FIELD

The present disclosure relates to a refrigeration cycle device.

BACKGROUND

For example, Patent Document 1 discloses a refrigeration cycle device including an accumulator provided in a low-pressure-side pipe between an evaporator and a compressor, and a fusible plug capable of opening the low-pressure-side pipe provided with the accumulator to an atmosphere.

PATENT DOCUMENT

Patent Document 1

Japanese Patent No. 6291333

In the refrigeration cycle device described in Patent Document 1, for example, a heat absorption member wound around the fusible plug as heat quantity reduction means is provided for suppressing unnecessary melting of a fusible portion of the fusible plug due to a high-temperature refrigerant flowing into the low-pressure-side pipe when reverse cycle defrosting is performed. Such a heat absorption member does not contribute to improvement of efficiency of the refrigeration cycle device and the like and is provided only for the purpose of suppressing malfunction of the fusible plug. Therefore, there is a problem in that the number of parts of the refrigeration cycle device increases due to the provision of the heat absorption member.

SUMMARY

In view of the above circumstances, one object of the present disclosure is to provide a refrigeration cycle device having a structure capable of suppressing malfunction of a fusible plug while suppressing an increase in the number of parts.

One aspect of a refrigeration cycle device in the present disclosure includes a first refrigerant circuit in which a compressor, a condenser, an internal heat exchanger, a first pressure-reducing device, and an evaporator are annularly connected; a second refrigerant circuit configured to branch from a branch portion of the first refrigerant circuit and merge with a merging portion of the first refrigerant circuit on a suction side of the compressor via the internal heat exchanger; and a pressure release means provided between the branch portion and the internal heat exchanger in the second refrigerant circuit.

According to the present disclosure, in a refrigeration cycle device, malfunction of a fusible plug can be suppressed while suppressing an increase in the number of parts.

DETAILED DESCRIPTION

A refrigeration cycle device according to embodiments of the present disclosure will be described below with reference to the drawings. Note that the scope of the present disclosure is not limited to the following embodiments, and can be changed as desired within the scope of technical ideas of the present disclosure. In the following drawings, the scale and number of each structure may be different from the scale and number of an actual structure in order to make each configuration easier to understand.

Embodiment 1

Figure 1:
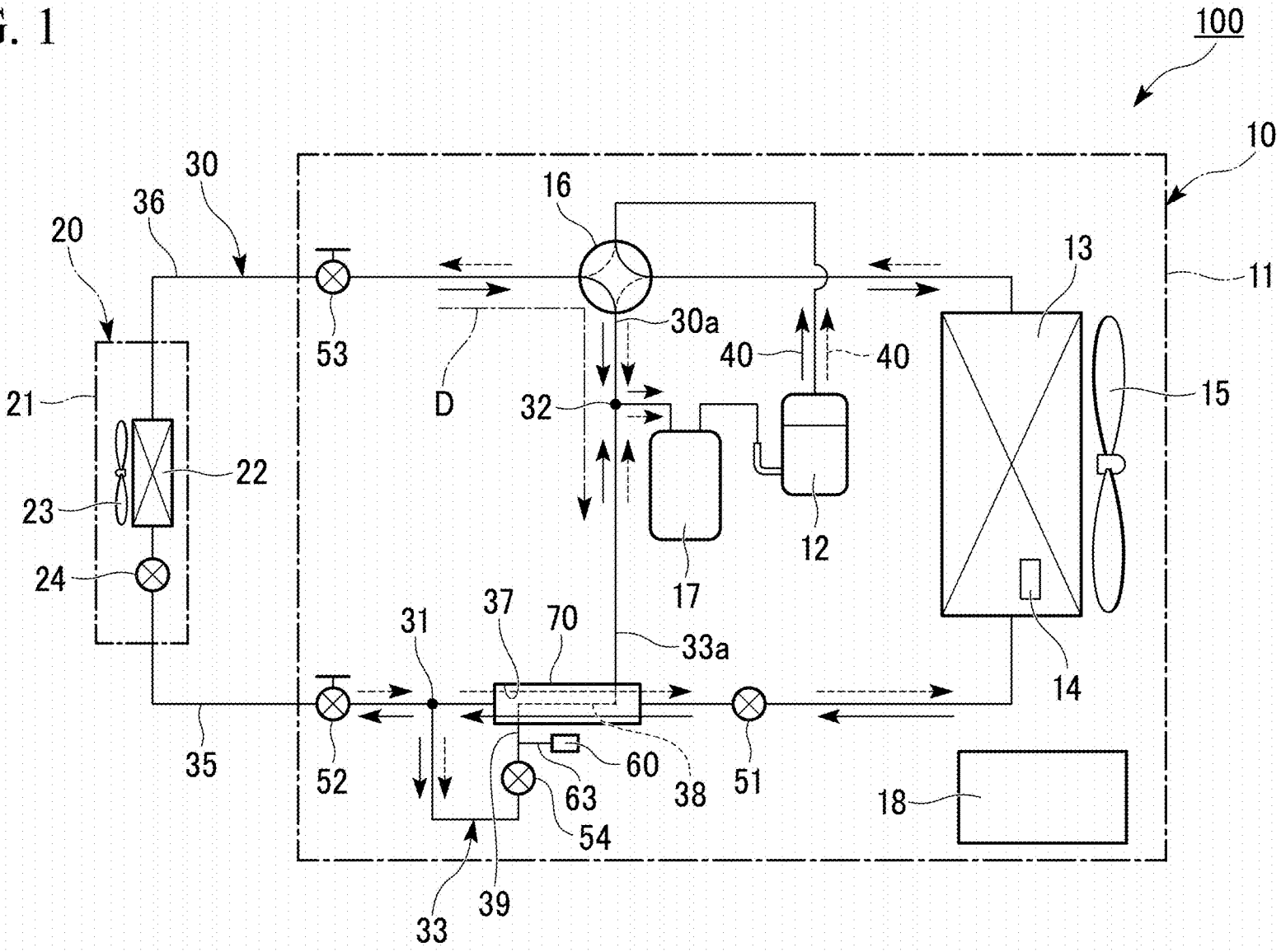
FIG. 1 is a refrigerant circuit diagram showing a schematic configuration of a refrigeration cycle device in Embodiment 1.

FIG. 1 is a refrigerant circuit diagram showing a schematic configuration of a refrigeration cycle device 100 in Embodiment 1. In Embodiment 1, the refrigeration cycle device 100 is an air conditioner. As shown in FIG. 1, the refrigeration cycle device 100 includes an outdoor unit 10 installed, for example, outdoors, an indoor unit 20 installed, for example, indoors, a circulation refrigerant circuit 30 that circulates a refrigerant 40, and a control device 18. In addition, in Embodiment 1, the circulation refrigerant circuit 30 corresponds to a "first refrigerant circuit".

The refrigeration cycle device 100 can regulate a temperature of indoor air by exchanging heat between the refrigerant 40 flowing inside the circulation refrigerant circuit 30 and the indoor air in a room in which the indoor unit 20 is arranged. The refrigeration cycle device 100 can perform a cooling operation for cooling the indoor air in the room in which the indoor unit 20 is arranged, a heating operation for warming the indoor air in the room in which the indoor unit 20 is arranged, and a defrosting operation that is performed to remove frost formed in an outdoor heat exchanger 13, which will be described later, of the outdoor unit 10. The type of the refrigerant 40 is not particularly limited. Examples of the refrigerant 40 include R410A.

The control device 18 is, for example, a control device that collectively controls the entire refrigeration cycle device 100. In Embodiment 1, the control device 18 is provided inside a housing 11 of the outdoor unit 10. The control device 18 can switch an operation of the refrigeration cycle device 100 between the cooling operation, the heating operation, and the defrosting operation.

In Embodiment 1, the circulation refrigerant circuit 30 has a configuration in which in a flow direction of the refrigerant 40 during the heating operation, a compressor 12, a four-way valve 16, an indoor heat exchanger 22, an indoor expansion valve 24, an internal heat exchanger 70, an outdoor expansion valve 51, the outdoor heat exchanger 13, and a pressure vessel 17 are annularly connected in this order via refrigerant pipes.

In Embodiment 1, the compressor 12, the four-way valve 16, the internal heat exchanger 70, the outdoor expansion valve 51, the outdoor heat exchanger 13, and the pressure vessel 17 are housed inside the housing 11 of the outdoor unit 10. An outdoor fan 15 that blows air to the outdoor heat exchanger 13 is provided inside the housing 11 of the outdoor unit 10.

In Embodiment 1, the indoor heat exchanger 22 and the indoor expansion valve 24 are housed inside the housing 21 of the indoor unit 20. An indoor fan 23 that blows air to the indoor heat exchanger 22 is provided inside the housing 21 of the indoor unit 20.

The outdoor unit 10 and the indoor unit 20 are connected by pipes 35 and 36 that are parts of the refrigerant pipes of the circulation refrigerant circuit 30. The pipe 35 connects a portion connected to the internal heat exchanger 70 out of the refrigerant pipes of the circulation refrigerant circuit 30 located inside the outdoor unit 10 and the refrigerant pipe of the circulation refrigerant circuit 30 located inside the indoor unit 20. The pipe 36 connects a portion connected to the four-way valve 16 out of the refrigerant pipes of the circulation refrigerant circuit 30 located inside the outdoor unit 10 and the refrigerant pipe of the circulation refrigerant circuit 30 located inside the indoor unit 20.

A connection valve 52 is provided between the internal heat exchanger 70 and the pipe 35 in the circulation refrigerant circuit 30. A connection valve 53 is provided between the four-way valve 16 and the pipe 36 in the circulation refrigerant circuit 30. The connection valves 52 and 53 are provided inside the housing 11 of the outdoor unit 10.

The compressor 12 is a fluid machine that compresses a sucked low-pressure refrigerant 40 and discharges the compressed refrigerant as a high-pressure refrigerant 40. The compressor 12 is, for example, a capacity-controllable inverter compressor. The refrigerant 40 circulates in the circulation refrigerant circuit 30 by driving the compressor 12.

The four-way valve 16 is arranged on a discharge side of the compressor 12. The four-way valve 16 can reverse a direction of the refrigerant 40 flowing inside the circulation refrigerant circuit 30 by switching a part of paths of the circulation refrigerant circuit 30. When a path connected by the four-way valve 16 is a path indicated by a solid line in the four-way valve 16 in FIG. 1, the refrigerant 40 flows inside the circulation refrigerant circuit 30 in a direction indicated by solid arrows in FIG. 1. On the other hand, when the path connected by the four-way valve 16 is a path indicated by a dashed line in the four-way valve 16 in FIG. 1, the refrigerant 40 flows inside the circulation refrigerant circuit 30 in a direction indicated by dashed arrows in FIG. 1.

The flow of the refrigerant 40 indicated by the solid line in FIG. 1 is a direction in which the refrigerant 40 flows during the cooling operation. The flow of the refrigerant 40 indicated by the dashed line in FIG. 1 is a direction in which the refrigerant 40 flows during the heating operation. During the cooling operation, a low-temperature and low-pressure refrigerant 40 is supplied into the indoor heat exchanger 22. During the heating operation, a high-temperature and high-pressure refrigerant 40 is supplied into the indoor heat exchanger 22.

The outdoor heat exchanger 13 is a heat exchanger that functions as an evaporator during the heating operation and functions as a condenser during the cooling operation. In the outdoor heat exchanger 13, heat exchange is performed between the refrigerant 40 flowing inside the outdoor heat exchanger 13 and the air (outdoor air) blown by the outdoor fan 15. In Embodiment 1, a temperature sensor 14 is attached to the outdoor heat exchanger 13.

The indoor heat exchanger 22 is a heat exchanger that functions as a condenser during the heating operation and functions as an evaporator during the cooling operation. In the indoor heat exchanger 22, heat exchange is performed between the refrigerant 40 flowing inside the indoor heat exchanger 22 and the air (indoor air) blown by the indoor fan 23.

The pressure vessel 17 is arranged on a suction side of the compressor 12. The pressure vessel 17 can store an excess refrigerant 40 therein. A liquid refrigerant 40 is stored in the pressure vessel 17. In Embodiment 1, the pressure vessel 17 is an accumulator. The pressure vessel 17 may be any vessel as long as the vessel can store the excess refrigerant 40.

In Embodiment 1, the outdoor expansion valve 51 is an electronic linear expansion valve of which a degree of opening can be continuously regulated. The degree of opening of the outdoor expansion valve 51 is regulated by, for example, the control device 18. For example, the degree of opening of the outdoor expansion valve 51 is fully opened during the cooling operation. Accordingly, during the cooling operation, the outdoor expansion valve 51 does not contribute to a state change of the refrigerant 40 passing through the outdoor expansion valve 51. On the other hand, during the heating operation, the outdoor expansion valve 51 decompresses and expands the refrigerant 40 after passing through the indoor expansion valve 24. During the heating operation, the refrigerant 40 that flows into the outdoor expansion valve 51 after passing through the indoor expansion valve 24 is a liquid refrigerant or a gas-liquid two-phase refrigerant.

In Embodiment 1, the indoor expansion valve 24 is an electronic linear expansion valve of which a degree of opening can be continuously regulated. The degree of opening of the indoor expansion valve 24 is regulated by, for example, the control device 18. The indoor expansion valve 24 decompresses and expands the liquid refrigerant 40 condensed in the outdoor heat exchanger 13 at least during the cooling operation. In Embodiment 1, the outdoor expansion valve 51 and the indoor expansion valve 24 correspond to a "first pressure-reducing device".

The refrigeration cycle device 100 further includes a bypass refrigerant circuit 33 connected to the circulation refrigerant circuit 30. The bypass refrigerant circuit 33 branches from a part of the circulation refrigerant circuit 30 and merges with another part of the circulation refrigerant circuit 30. In Embodiment 1, the bypass refrigerant circuit 33 connects a branch portion 31 located between the connection valve 52 and the internal heat exchanger 70 in the circulation refrigerant circuit 30, and a merging portion 32 located between the pressure vessel 17 and the four-way valve 16 in the circulation refrigerant circuit 30. In Embodiment 1, the merging portion 32 is located in front of the pressure vessel 17. The bypass refrigerant circuit 33 passes through the internal heat exchanger 70. That is, the bypass refrigerant circuit 33 is a circuit that branches from the branch portion 31 of the circulation refrigerant circuit 30 and merges with the merging portion 32 of the circulation refrigerant circuit 30 on the suction side of the compressor 12 via the internal heat exchanger 70. In Embodiment 1, the bypass refrigerant circuit 33 corresponds to a "second refrigerant circuit".

As indicated by the solid arrows in FIG. 1, during the cooling operation, the refrigerant 40 flowing inside the circulation refrigerant circuit 30 branches at the branch portion 31 into the refrigerant 40 that flows to the indoor heat exchanger 22 passing through the connection valve 52 and the indoor expansion valve 24 and the refrigerant 40 that flows to the bypass refrigerant circuit 33. On the other hand, as indicated by the dashed arrows in FIG. 1, during the heating operation, the refrigerant 40 flowing inside the circulation refrigerant circuit 30 branches at the branch portion 31 into the refrigerant that flows to the outdoor heat exchanger 13 passing through the internal heat exchanger 70 and the outdoor expansion valve 51 and the refrigerant 40 that flows to the bypass refrigerant circuit 33.

The refrigerant 40 branched into the circulation refrigerant circuit 30 and the bypass refrigerant circuit 33 at the branch portion 31 merges at the merging portion 32 and flows through the pressure vessel 17 to the compressor 12. During the cooling operation, the refrigerant 40 branched into the bypass refrigerant circuit 33 at the branch portion 31 merges at the merging portion 32 with the refrigerant 40 that passes through the indoor heat exchanger 22, the connection valve 53, and the four-way valve 16 toward the pressure vessel 17, out of the refrigerant 40 flowing inside the circulation refrigerant circuit 30. During the heating operation, the refrigerant 40 branched into the bypass refrigerant circuit 33 at the branch portion 31 merges at the merging portion 32 with the refrigerant 40 that passes through the outdoor heat exchanger 13 and the four-way valve 16 toward the pressure vessel 17, out of the refrigerant 40 flowing inside the circulation refrigerant circuit 30. In addition, although the branch portion 31 is located between the connection valve 52 and the internal heat exchanger 70 in Embodiment 1, the present disclosure is not limited thereto. The branch portion 31 may be located, for example, between the internal heat exchanger 70 and the outdoor expansion valve 51.

The bypass refrigerant circuit 33 is provided with an expansion valve 54 and a fusible plug 60. In Embodiment 1, the expansion valve 54 is an electronic linear expansion valve of which a degree of opening can be continuously regulated. The degree of opening of the expansion valve 54 is regulated by, for example, the control device 18. In Embodiment 1, the expansion valve 54 corresponds to a "second pressure-reducing device".

Figure 2:
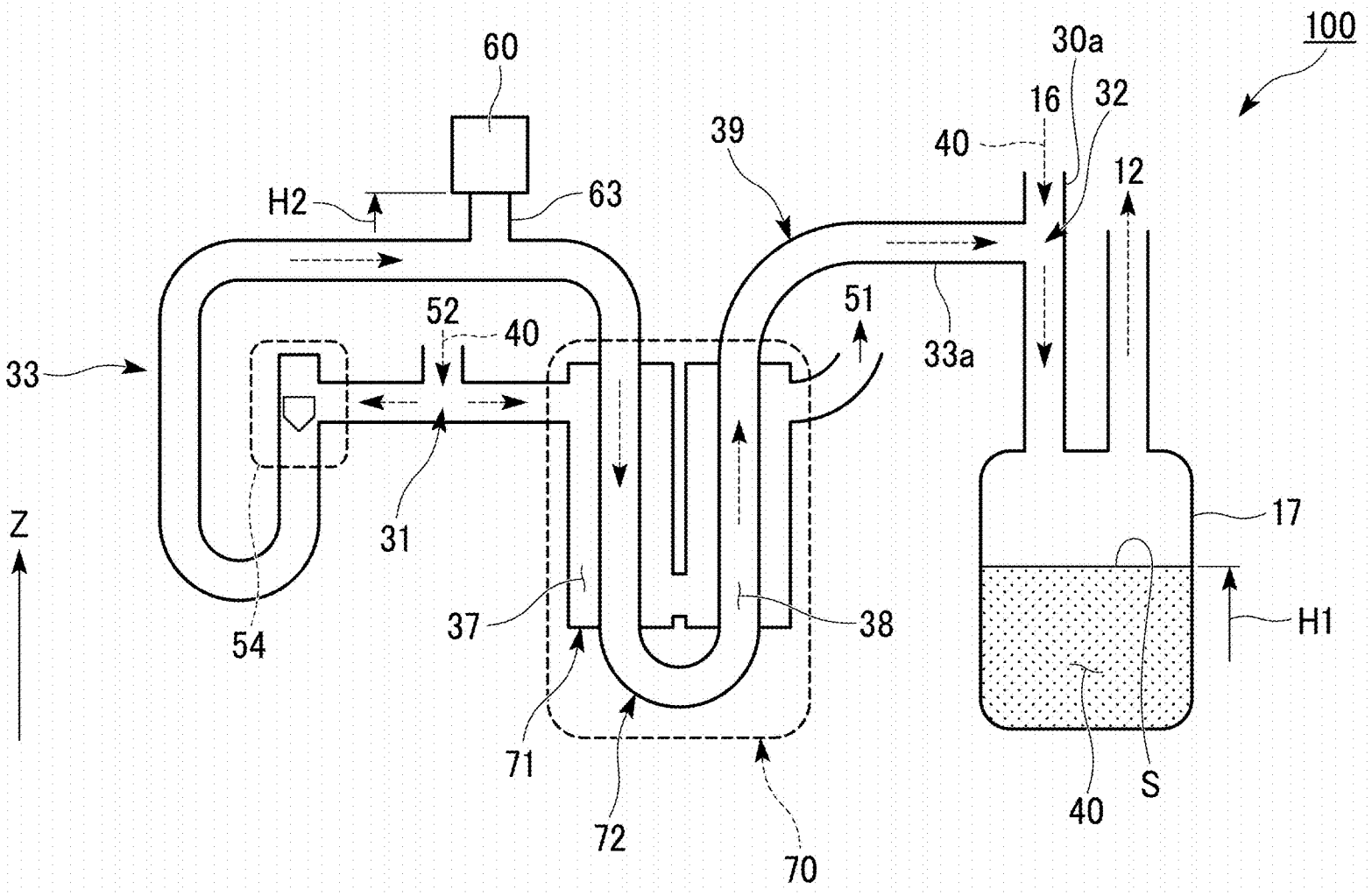
FIG. 2 is a diagram showing a bypass refrigerant circuit of Embodiment 1.
Figure 3:
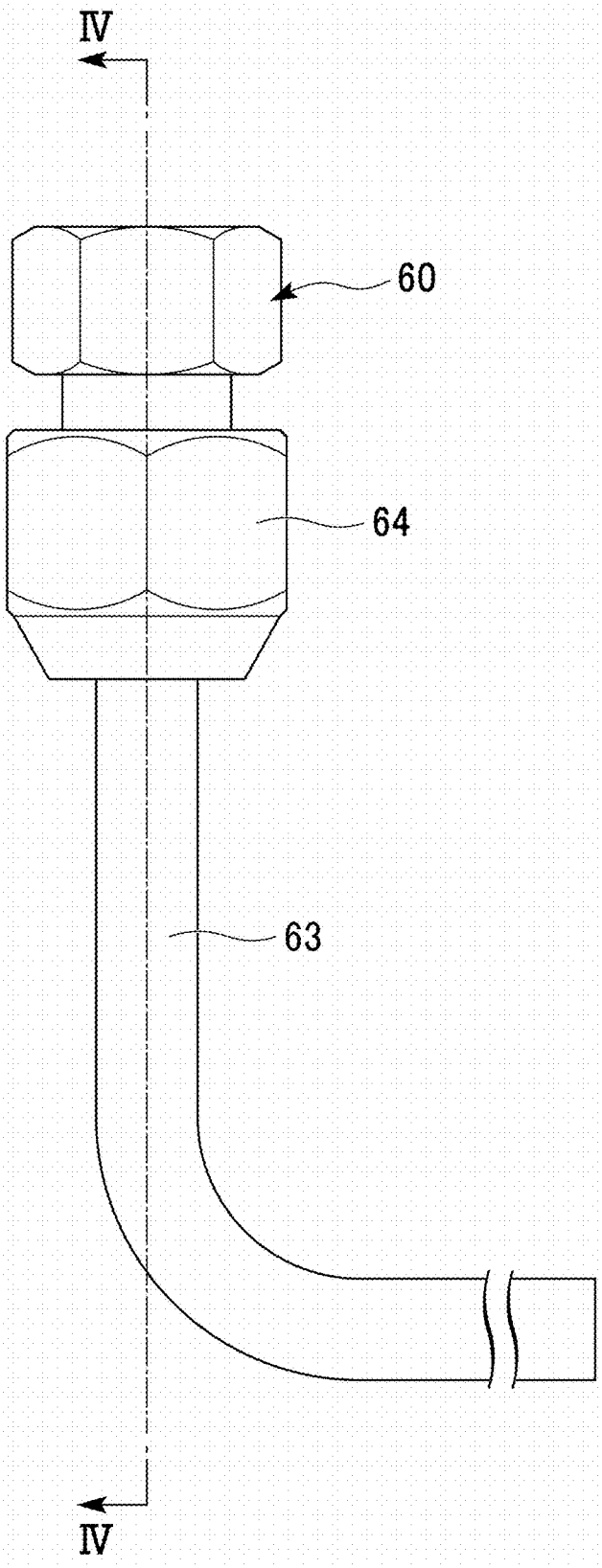
FIG. 3 is a diagram showing a fusible plug in Embodiment 1.
Figure 4:
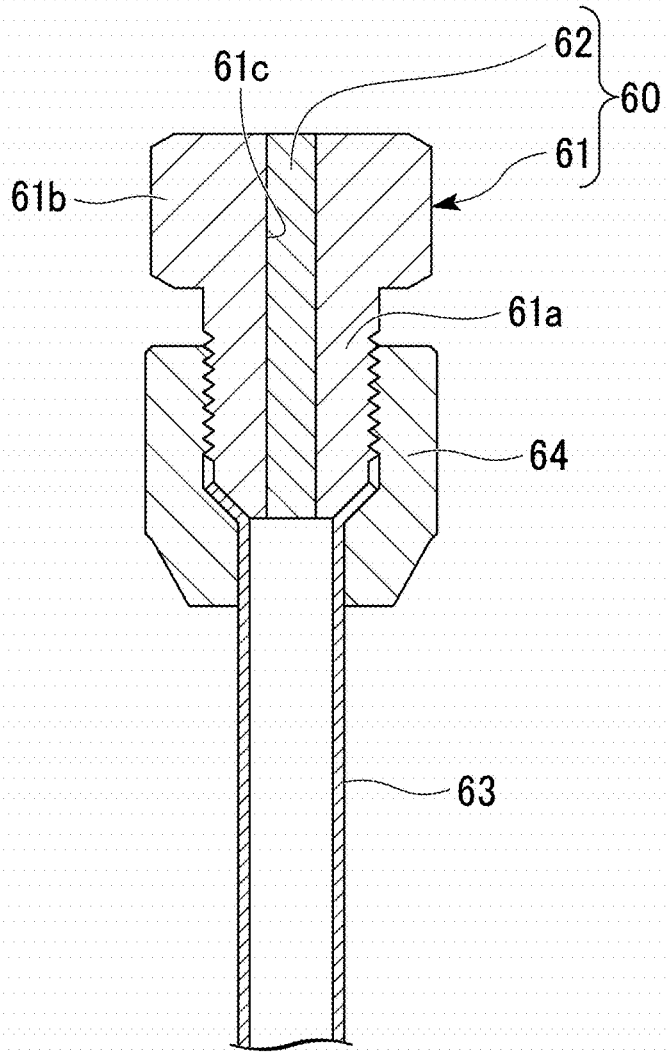
FIG. 4 is a cross-sectional view showing the fusible plug in Embodiment 1, which is taken along a line IV-IV in FIG. 3.

FIG. 2 shows the bypass refrigerant circuit 33 of Embodiment 1. FIG. 3 shows the fusible plug 60 in Embodiment 1. FIG. 4 is a cross-sectional view showing the fusible plug 60 in Embodiment 1, which is a cross-sectional view taken along a line IV-IV in FIG. 3.

In addition, in FIG. 2, the direction of gravity is indicated by a Z-axis. A direction in which an arrow of the Z-axis points in the direction of gravity is upward in the direction of gravity, and a direction opposite to the direction in which the arrow of the Z-axis points in the direction of gravity is downward in the direction of gravity. Further, in FIG. 2, a detailed pipe shape and the like inside the pressure vessel 17 are not shown.

As shown in FIG. 2, the fusible plug 60 is located between the expansion valve 54 and an inner pipe 72, which will be described later, of the internal heat exchanger 70 in the bypass refrigerant circuit 33. The fusible plug 60 is attached to a branch pipe 63 connected to the refrigerant pipe of the bypass refrigerant circuit 33. As shown in FIG. 3, in Embodiment 1, the fusible plug 60 is fixed to a distal end portion of the branch pipe 63 with a flare nut 64. The fusible plug 60 may be fixed to the branch pipe 63 by, for example, a tapered screw for pipe.

As shown in FIG. 4, the fusible plug 60 has a substantially cylindrical plug body portion 61 and a fusible portion 62 that melts at a temperature equal to or higher than a predetermined value. A material forming the plug body portion 61 is, for example, brass. The plug body portion 61 has a small diameter portion 61*a* and a large diameter portion 61*b* having an outer diameter larger than that of the small diameter portion 61*a*. An outer peripheral surface of the small diameter portion 61*a* is provided with a male thread portion that is screwed into a female thread portion provided on an inner peripheral surface of the flare nut 64. One end portion of the small diameter portion 61*a* is in contact with the distal end portion of the branch pipe 63. The large diameter portion 61*b* is connected to the other end portion of the small diameter portion 61*a*.

The plug body portion 61 has a through-hole 61*c* penetrating through the plug body portion 61 in an axial direction of the plug body portion 61. One end portion of the through-hole 61*c* is open to an inside of the branch pipe 63. The other end portion of the through-hole 61*c* is open to an outside of the branch pipe 63. The other end portion of the through-hole 61*c* is open into an atmospheric pressure atmosphere.

The fusible portion 62 is packed into the through-hole 61*c*. Therefore, the through-hole 61*c* is closed by the fusible portion 62. A material forming the fusible portion 62 is an alloy with a relatively low melting temperature. The melting temperature of the material forming the fusible portion 62 is lower than a melting temperature of the material forming the plug body portion 61. The melting temperature of the fusible portion 62 is set to, for example, a critical temperature of the refrigerant 40 to be used or less. As an example, when R410A is used as the refrigerant 40, since a critical temperature of R410A is 71.4° C., the melting temperature of the fusible portion 62 is set to 70° C. which is lower than 71.4° C.

The fusible portion 62 melts, for example, when an ambient temperature of the pressure vessel 17 rises abnormally and the inside of the pressure vessel 17 becomes a high temperature and a high pressure. When the fusible portion 62 melts, the through-hole 61*c* is opened, and the inside of the branch pipe 63 and the outside of the branch pipe 63 are connected. Thus, a pressure in the bypass refrigerant circuit 33 and a pressure in the circulation refrigerant circuit 30 can be released to an atmospheric pressure via the branch pipe 63. Accordingly, a pressure in the pressure vessel 17 can be released to the atmospheric pressure to be released to the outside. Therefore, failures such as rupture of the pressure vessel 17 can be suppressed.

As shown in FIG. 2, a height H2 of the fusible plug 60 is higher than a height H1 of a liquid surface S of the liquid refrigerant 40 stored in the pressure vessel 17 in the direction of gravity. In Embodiment 1, the pressure vessel 17 and the fusible plug 60 are directly connected only by a refrigerant pipe 39. The refrigerant pipe 39 is a pipe extending from the fusible plug 60 to the pressure vessel 17 and includes the branch pipe 63 and the inner pipe 72. Components other than the refrigerant pipe 39 are not provided between the pressure vessel 17 and the fusible plug 60. The components other than the refrigerant pipe 39 include, for example, a valve member such as an electronic expansion valve and a check valve that can block a part of the inside of the refrigerant pipe, and a capillary. That is, in Embodiment 1, the refrigerant pipe 39 connecting the pressure vessel 17 and the fusible plug 60 is provided with neither the valve member nor the capillary.

In the internal heat exchanger 70, heat exchange is performed between the refrigerant 40 flowing inside the circulation refrigerant circuit 30 and the refrigerant 40 flowing inside the bypass refrigerant circuit 33. In Embodiment 1, in the internal heat exchanger 70, heat exchange is performed between the refrigerant 40 flowing between the branch portion 31 and the outdoor expansion valve 51 in the circulation refrigerant circuit 30 and the refrigerant 40 flowing between the expansion valve 54 and the merging portion 32 in the bypass refrigerant circuit 33, that is, the refrigerant 40 after being decompressed by the expansion valve 54.

As shown in FIG. 2, in Embodiment 1, the internal heat exchanger 70 is a double-pipe heat exchanger having an outer pipe 71 and the inner pipe 72 extending inside the outer pipe 71. In an example of FIG. 2, the outer pipe 71 and the inner pipe 72 extend in a substantially U-shape. A folded portion of the U-shaped inner pipe 72 is exposed to an outside of the outer pipe 71. The outer pipe 71 and the inner pipe 72 form an outer flow path portion 37 provided between the outer pipe 71 and the inner pipe 72. An inner surface of the outer flow path portion 37 is formed by an inner surface of the outer pipe 71 and an outer surface of the inner pipe 72. The outer flow path portion 37 forms a part of the circulation refrigerant circuit 30. An inner flow path portion 38 is formed by the inner pipe 72. An inner surface of the inner flow path portion 38 is formed by an inner surface of the inner pipe 72. The inner flow path portion 38 forms a part of the bypass refrigerant circuit 33. A medium-pressure or low-pressure refrigerant decompressed by the expansion valve 54 flows through the inner flow path portion 38.

In addition, for example, the outer flow path portion 37 may form a part of the bypass refrigerant circuit 33 and the inner flow path portion 38 may form a part of the circulation refrigerant circuit 30. In this case, the medium-pressure or low-pressure refrigerant 40 decompressed by the expansion valve 54 flows through the outer flow path portion 37. Further, the internal heat exchanger 70 is not limited to a double-pipe heat exchanger and may be, for example, a plate heat exchanger.

Figure 5:
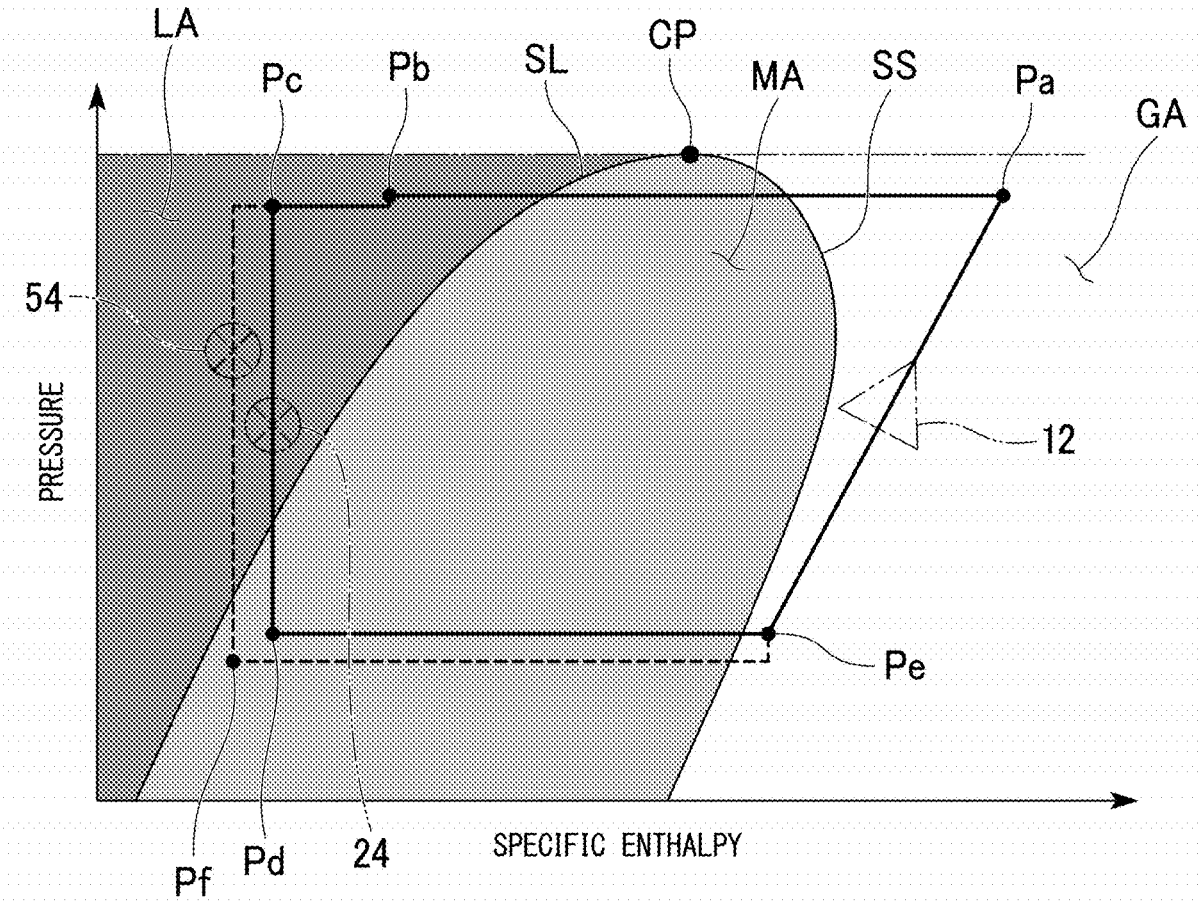
FIG. 5 is a Mollier diagram showing an example of a state change of a refrigerant during a cooling operation.
Figure 6:
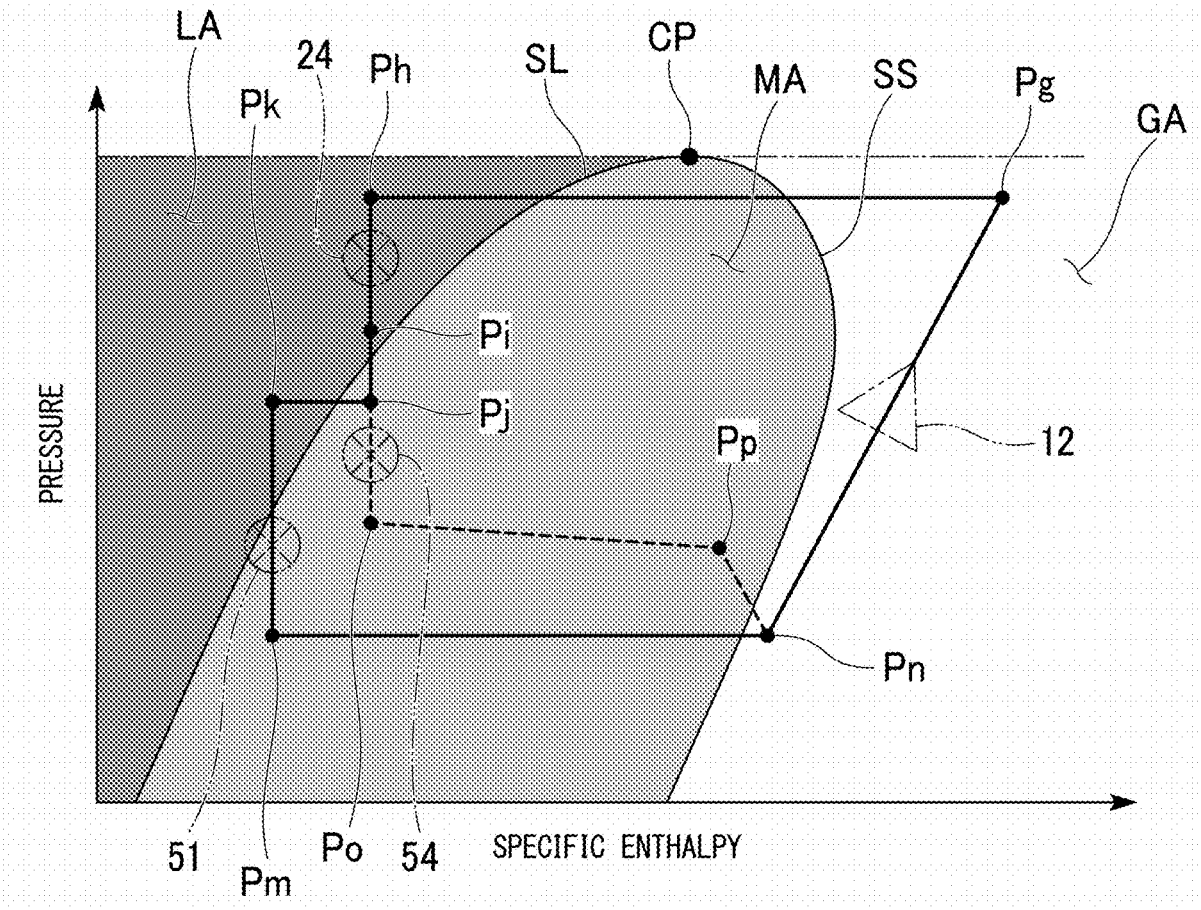
FIG. 6 is a Mollier diagram showing an example of a state change of the refrigerant during a heating operation.

Next, a flow of the refrigerant 40 and a state change of the refrigerant 40 will be described in detail. FIG. 5 is a Mollier diagram showing an example of the state change of the refrigerant 40 during the cooling operation. FIG. 6 is a Mollier diagram showing an example of the state change of the refrigerant 40 during the heating operation. In the Mollier diagrams shown in FIGS. 5 and 6, a horizontal axis indicates a specific enthalpy of the refrigerant 40 and a vertical axis indicates a pressure of the refrigerant 40. The Mollier diagrams shown in FIGS. 5 and 6 show a saturated liquid line SL, a saturated steam line SS, and a critical point CP. The saturated liquid line SL and the saturated steam line SS are connected at the critical point CP.

In a region GA where the pressure of the refrigerant 40 is equal to or less than a pressure at the critical point CP and the specific enthalpy of the refrigerant 40 is higher than the saturated steam line SS, the refrigerant 40 is in a gaseous state, that is, a gas refrigerant. In a region MA surrounded by the saturated liquid line SL and the saturated steam line SS, the refrigerant 40 is in a state in which gas and liquid are mixed, that is, a gas-liquid two-phase refrigerant. In a region LA where the pressure of the refrigerant 40 is equal to or less than the pressure at the critical point CP and the specific enthalpy of the refrigerant 40 is lower than the saturated liquid line SL, the refrigerant 40 is in a liquid state, that is, a liquid refrigerant.

Each of graphs indicated by the solid lines in the Mollier diagrams of FIGS. 5 and 6 shows state changes of the refrigerant 40 flowing inside the circulation refrigerant circuit 30. Each of graphs indicated by dashed lines in the Mollier diagrams of FIGS. 5 and 6 shows state changes of the refrigerant 40 flowing inside the bypass refrigerant circuit 33.

First, the flow of the refrigerant 40 and the state change of the refrigerant 40 during the cooling operation will be described. The flow of the refrigerant 40 during the cooling operation is indicated by solid arrows in FIG. 1. The state change of the refrigerant 40 during the cooling operation is shown by the Mollier diagram of FIG. 5.

During the cooling operation, the refrigerant 40 compressed by the compressor 12 becomes a high-temperature and high-pressure gas refrigerant. A state of the refrigerant 40 after being compressed by compressor 12 is indicated by a point Pa in FIG. 5. As indicated by the solid arrows in FIG. 1, the refrigerant 40 compressed by the compressor 12 during the cooling operation flows through the four-way valve 16 into the outdoor heat exchanger 13. During the cooling operation, the outdoor heat exchanger 13 functions as a condenser. That is, in the outdoor heat exchanger 13 during the cooling operation, heat exchange is performed between the gaseous refrigerant 40 flowing inside the outdoor heat exchanger 13 and the air (outdoor air) blown by the outdoor fan 15, and condensation heat of the refrigerant 40 is radiated to the air blown by the outdoor fan 15. Thus, the refrigerant 40 that has flowed into the outdoor heat exchanger 13 is condensed to become a high-pressure liquid refrigerant. Further, the air blown by the outdoor fan 15 is heated by heat radiation action of the refrigerant 40 and becomes warm air. A state of the refrigerant 40 after being condensed in the outdoor heat exchanger 13 is indicated by a point Pb in FIG. 5.

As indicated by the solid arrows in FIG. 1, during the cooling operation, the refrigerant 40 condensed in the outdoor heat exchanger 13 to become a high-pressure liquid refrigerant passes through the outer flow path portion 37 of the internal heat exchanger 70 to reach the branch portion 31. At the branch portion 31, a part of the refrigerant 40 is branched to the bypass refrigerant circuit 33. The remaining refrigerant 40 passes through the connection valve 52 and flows into the indoor expansion valve 24. The refrigerant 40 branched to the bypass refrigerant circuit 33 is decompressed by the expansion valve 54 to become a low-pressure gas-liquid two-phase refrigerant and flows into the inner flow path portion 38 of the internal heat exchanger 70. A state of the refrigerant 40 after being decompressed by the expansion valve 54 is indicated by a point Pf in FIG. 5.

The specific enthalpy of the refrigerant 40 that has passed through the outer flow path portion 37 decreases due to heat exchange with the low-pressure gas-liquid two-phase refrigerant that has flowed into the inner flow path portion 38. A state of the refrigerant 40 after passing through the outer flow path portion 37 is indicated by a point Pc in FIG. 5. On the other hand, the specific enthalpy of the refrigerant 40 that has flowed into the inner flow path portion 38 increases due to heat exchange with the high-pressure liquid refrigerant that has flowed into the outer flow path portion 37. Thus, the refrigerant 40 that has passed through the inner flow path portion 38 becomes a gas-liquid two-phase refrigerant or a gas refrigerant with a high degree of dryness. A state of the refrigerant 40 after passing through the inner flow path portion 38 is indicated by a point Pe in FIG. 5. In an example of FIG. 5, the refrigerant 40 is a gas refrigerant at the point Pe.

The refrigerant 40 that has flowed into the indoor expansion valve 24 is decompressed to become a low-pressure gas-liquid two-phase refrigerant. A state of the refrigerant 40 after passing through the indoor expansion valve 24 to become a low-pressure two-phase refrigerant is indicated by a point Pd in FIG. 5. As indicated by the solid arrows in FIG. 1, the refrigerant 40 that has become a low-pressure gas-liquid two-phase refrigerant in the indoor expansion valve 24 flows into the indoor heat exchanger 22. During the cooling operation, the indoor heat exchanger 22 functions as an evaporator. That is, in the indoor heat exchanger 22, heat exchange is performed between the refrigerant 40 flowing inside the indoor heat exchanger 22 and the air (indoor air) blown by the indoor fan 23, and evaporation heat of the refrigerant 40 is absorbed from the air sent by the indoor fan 23. Thus, the refrigerant 40 that has flowed into the indoor heat exchanger 22 evaporates to become a low-pressure gas refrigerant. The refrigerant 40 after passing through the indoor heat exchanger 22 to become a low-pressure gas refrigerant is indicated by the point Pe in FIG. 5.

As indicated by the solid arrows in FIG. 1, during the cooling operation, the refrigerant 40 that has passed through the indoor heat exchanger 22 to become a low-pressure gas refrigerant passes through the four-way valve 16, merges with the refrigerant 40 that has passed through the bypass refrigerant circuit 33 at the merging portion 32, and is sucked into the compressor 12 through the pressure vessel 17. The refrigerant 40 sucked into the compressor 12 is compressed by the compressor 12 and becomes a high-temperature and high-pressure gas refrigerant again.

During the cooling operation described above, the state of the refrigerant 40 flowing through a portion where the fusible plug 60 is provided in the bypass refrigerant circuit 33 is indicated by the point Pf in FIG. 5. A temperature of the refrigerant 40 in the state of the point Pf is about 5° C. or higher and 18° C. or lower, depending on an operating state. Therefore, during the cooling operation, melting of the fusible portion 62 of the fusible plug 60 due to the heat of the refrigerant 40 is suppressed. Accordingly, during the cooling operation, malfunction of the fusible plug 60 is suppressed.

Next, the flow of the refrigerant 40 and the state change of the refrigerant 40 during the heating operation will be described. The flow of the refrigerant 40 during the heating operation is indicated by dashed arrows in FIG. 1. The state change of the refrigerant 40 during the heating operation is shown by the Mollier diagram of FIG. 6.

As in the cooling operation, also in the heating operation, the refrigerant 40 compressed by the compressor 12 becomes a high-temperature and high-pressure gas refrigerant. A state of the refrigerant 40 after being compressed by compressor 12 is indicated by a point Pg in FIG. 6. As indicated by the dashed arrows in FIG. 1, the refrigerant 40 compressed by the compressor 12 flows into the indoor heat exchanger 22 through the four-way valve 16. During the heating operation, the indoor heat exchanger 22 functions as a condenser. That is, during the heating operation, in the indoor heat exchanger 22, heat exchange is performed between the gaseous refrigerant 40 flowing inside the indoor heat exchanger 22 and the air (indoor air) blown by the indoor fan 23, and condensation heat of the refrigerant 40 is radiated to the air blown by the indoor fan 23. Thus, the refrigerant 40 that has flowed into the indoor heat exchanger 22 is condensed to become a high-pressure liquid refrigerant. Further, the air blown by the indoor fan 23 is heated by heat radiation action of the refrigerant 40 and becomes warm air. A state of the refrigerant 40 after being condensed in the indoor heat exchanger 22 is indicated by a point Ph in FIG. 6.

As indicated by the dashed arrows in FIG. 1, during the heating operation, the refrigerant 40 condensed in the indoor heat exchanger 22 to become a high-pressure liquid refrigerant flows into the indoor expansion valve 24 and is decompressed by the indoor expansion valve 24 to become a medium-pressure liquid refrigerant. A state of the medium-pressure refrigerant 40 after being decompressed by the indoor expansion valve 24 is indicated by a point Pi in FIG. 6. The refrigerant 40 that has flowed out of the indoor expansion valve 24 is decompressed by pressure loss when passing through the pipe 35 and flows into the outdoor unit 10 in a state of a liquid refrigerant or gas-liquid two-phase refrigerant. A state of the refrigerant 40 when flowing into the outdoor unit 10 after passing through the pipe 35 from the indoor expansion valve 24 is indicated by a point Pj in FIG. 6. In an example of FIG. 6, the refrigerant 40 is a gas-liquid two-phase refrigerant at the point Pj.

As indicated by the dashed arrows in FIG. 1, during the heating operation, a part of the refrigerant 40 that has flowed into the outdoor unit 10 is branched to the bypass refrigerant circuit 33 at the branch portion 31. The remaining refrigerant 40 flows into the outer flow path portion 37 of the internal heat exchanger 70. The refrigerant 40 branched to the bypass refrigerant circuit 33 is decompressed by the expansion valve 54 to become a low-pressure gas-liquid two-phase refrigerant and flows into the inner flow path portion 38 of the internal heat exchanger 70. A state of the refrigerant 40 after being decompressed by the expansion valve 54 is indicated by a point Po in FIG. 6.

The specific enthalpy of the refrigerant 40 that has passed through the outer flow path portion 37 decreases due to heat exchange with the low-pressure gas-liquid two-phase refrigerant that has flowed into the inner flow path portion 38. A state of the refrigerant 40 after passing through the outer flow path portion 37 is indicated by a point Pk in FIG. 6. In the example of FIG. 6, when changing from the state of the point Pj to the state of the point Pk, the refrigerant 40 changes from the gas-liquid two-phase refrigerant to the liquid refrigerant. On the other hand, the specific enthalpy of the refrigerant 40 that has flowed into the inner flow path portion 38 increases due to heat exchange with the refrigerant 40 that has flowed into the outer flow path portion 37. Thus, the refrigerant 40 that has passed through the inner flow path portion 38 becomes a gas-liquid two-phase refrigerant or a gas refrigerant with a high degree of dryness. A state of the refrigerant 40 after passing through the inner flow path portion 38 is indicated by a point Pp in FIG. 6. In the example of FIG. 6, the refrigerant 40 remains the gas-liquid two-phase refrigerant at the point Pp.

As indicated by the dashed arrows in FIG. 1, during the heating operation, the refrigerant 40 that has passed through the outer flow path portion 37 is decompressed by the outdoor expansion valve 51 to become a low-pressure gas-liquid two-phase refrigerant and flows into the outdoor heat exchanger 13. A state of the refrigerant 40 after being decompressed by the outdoor expansion valve 51 is indicated by a point Pm in FIG. 6. During the heating operation, the outdoor heat exchanger 13 functions as an evaporator. That is, in the outdoor heat exchanger 13, heat exchange is performed between the refrigerant 40 flowing inside the outdoor heat exchanger 13 and the air (outdoor air) blown by the outdoor fan 15, and evaporation heat of the refrigerant 40 is absorbed from the air blown by the outdoor fan 15. Thus, the refrigerant 40 that has flowed into the outdoor heat exchanger 13 evaporates to become a low-pressure gas refrigerant. A state of the refrigerant 40 after passing through the outdoor heat exchanger 13 to become a low-pressure gas refrigerant is indicated by a point Pn in FIG. 6.

As indicated by the dashed arrows in FIG. 1, during the heating operation, the refrigerant 40 that has passed through the outdoor heat exchanger 13 to become a low-pressure gas refrigerant passes through the four-way valve 16, merges with the refrigerant 40 that has passed through the bypass refrigerant circuit 33 at the merging portion 32, and is sucked into the compressor 12 through the pressure vessel 17. The refrigerant 40 sucked into the compressor 12 is compressed by the compressor 12 and becomes a high-temperature and high-pressure gas refrigerant again.

During the heating operation described above, the state of the refrigerant 40 flowing through a portion where the fusible plug 60 is provided in the bypass refrigerant circuit 33 is indicated by the point Po in FIG. 6. A temperature of the refrigerant 40 in the state of the point Po is about 10° C. or higher and 18° C. or lower, depending on an operating state. Therefore, also during the heating operation, melting of the fusible portion 62 of the fusible plug 60 due to the heat of the refrigerant 40 is suppressed. Accordingly, also during the heating operation, malfunction of the fusible plug 60 is suppressed.

Next, the defrosting operation will be described. The defrosting operation is performed to remove frost formed in the outdoor heat exchanger 13. During the heating operation described above, the refrigerant 40 flowing through the outdoor heat exchanger 13 functioning as an evaporator takes heat from the air blown from the outdoor fan 15. Therefore, during the heating operation, a temperature of the outdoor heat exchanger 13 decreases, and frost may adhere to a surface of the outdoor heat exchanger 13. When the frost accumulates on the surface of the outdoor heat exchanger 13, the air blown from the outdoor fan 15 becomes difficult to pass through the outdoor heat exchanger 13. Therefore, a heat exchange efficiency of the outdoor heat exchanger 13 may be lowered, and a heating capacity in the heating operation may be lowered. Accordingly, when the heating operation is performed continuously to some extent, it is necessary to periodically perform the defrosting operation to remove the frost formed in the outdoor heat exchanger 13.

In Embodiment 1, the defrosting operation that can be performed by the refrigeration cycle device 100 is a reverse cycle defrosting operation. In Embodiment 1, a direction in which the refrigerant 40 flows inside the circulation refrigerant circuit 30 during the defrosting operation is opposite to a direction in which the refrigerant 40 flows inside the circulation refrigerant circuit 30 during the heating operation. The direction in which the refrigerant 40 flows inside the circulation refrigerant circuit 30 during the defrosting operation is the same as a direction in which the refrigerant 40 flows inside the circulation refrigerant circuit 30 during the cooling operation.

The defrosting operation is performed based on a detection result of the temperature sensor 14 provided in the outdoor heat exchanger 13. For example, when the control device 18 successively detects that the temperature of the outdoor heat exchanger 13 detected by the temperature sensor 14 during the heating operation is equal to or lower than a predetermined temperature to some extent, the control device 18 causes the refrigeration cycle device 100 to perform the defrosting operation. When the control device 18 causes the refrigeration cycle device 100 to perform the defrosting operation, the control device 18 switches the four-way valve 16 such that a direction in which the refrigerant 40 flows inside the circulation refrigerant circuit 30 is reversed from that in the heating operation. As a result, the high-temperature gaseous refrigerant 40 discharged from the compressor 12 flows into the outdoor heat exchanger 13, and the heat of the refrigerant 40 melts the frost adhering to the outdoor heat exchanger 13. During the defrosting operation, for example, when the control device 18 determines that the frost adhering to the outdoor heat exchanger 13 has melted based on the temperature of the outdoor heat exchanger 13 detected by the temperature sensor 14, the control device 18 switches the four-way valve 16 to terminate the defrosting operation and causes the refrigeration cycle device 100 to perform the heating operation again.

When the defrosting operation is started, the high-temperature gaseous refrigerant 40 inside the pipe 36 flows into the pressure vessel 17 via the merging portion 32 as indicated by the solid arrows in FIG. 1. Here, when the defrosting operation is started, the refrigerant 40 flowing from the pipe 36 may flow into the bypass refrigerant circuit 33 over the merging portion 32 as indicated by a dashed-dotted arrow D in FIG. 1. Thus, when the defrosting operation is started, a temperature of the refrigerant 40 in a first portion 30*a* between the four-way valve 16 and the pressure vessel 17 in the circulation refrigerant circuit 30 and a temperature of the refrigerant 40 in a second portion 33*a* between the internal heat exchanger 70 and the merging portion 32 in the bypass refrigerant circuit 33 may increase to the melting temperature of the fusible portion 62 of the fusible plug 60 or higher.

Specifically, when the defrosting operation is started, the temperature of the refrigerant 40 in the pipe 36 is, for example, about 100° C. When the defrosting operation is started, if the refrigerant 40 inside the pipe 36 flows into the first portion 30*a* and the second portion 33*a*, the temperature of the refrigerant 40 inside the first portion 30*a* and the temperature of the refrigerant 40 inside the second portion 33*a* may be, for example, about 73° C. or higher and 80° C. or lower, and may be equal to or higher than 70° C. which is the melting temperature of the fusible portion 62.

Therefore, for example, when the fusible plug 60 is arranged in the first portion of the circulation refrigerant circuit 30 and the second portion 33*a* of the bypass refrigerant circuit 33 described above, the fusible portion 62 of the fusible plug 60 may melt due to the heat of the refrigerant 40 to cause the fusible plug 60 to malfunction when the defrosting operation is started.

In contrast, according to Embodiment 1, the fusible plug 60 as pressure release means is provided between the branch portion 31 and the internal heat exchanger 70 in the bypass refrigerant circuit 33. Therefore, as indicated by the dashed-dotted arrow D in FIG. 1, when the defrosting operation is started, even if the refrigerant 40 inside the pipe 36 flows into the bypass refrigerant circuit 33, and the refrigerant 40 reaches a portion where the fusible plug 60 is provided in the bypass refrigerant circuit 33, the refrigerant 40 needs to pass through the internal heat exchanger 70 before reaching the portion where the fusible plug 60 is provided in the bypass refrigerant circuit 33. Therefore, the temperature of the refrigerant 40 reaching the portion where the fusible plug 60 is provided in the bypass refrigerant circuit 33 can be lowered by heat exchange in the internal heat exchanger 70. Thus, the temperature of the refrigerant 40 reaching the portion where the fusible plug 60 is provided in the bypass refrigerant circuit 33 is easy to be made lower than the melting temperature of the fusible portion 62 of the fusible plug 60 and malfunction of the fusible plug 60 due to melting of the fusible portion 62 can be suppressed.

Specifically, in Embodiment 1, when the refrigerant 40 inside the pipe 36 flows into the bypass refrigerant circuit 33 and reaches the portion where the fusible plug 60 is provided, the refrigerant 40 flows through the inner flow path portion 38 in the internal heat exchanger 70. The refrigerant 40 flowing inside the inner flow path portion 38 is heat-exchanged with the refrigerant 40 flowing inside the outer flow path portion 37. The temperature of the refrigerant 40 flowing inside the outer flow path portion 37 is, for example, about 30° C. or higher and 40° C. or lower. Therefore, the temperature of the refrigerant 40 passing through the inner flow path portion 38 and reaching the portion where the fusible plug 60 is provided is, for example, about 30° C. or higher and 40° C. or lower, which is lower than the melting temperature of the fusible portion 62. Therefore, it is possible to suppress melting of the fusible portion 62 and suppress malfunction of the fusible plug 60.

For example, when the ambient temperature of the outdoor unit 10 increases abnormally due to a fire or the like, all components included in the outdoor unit 10 such as the outer flow path portion 37 of the internal heat exchanger 70, the inner flow path portion 38 of the internal heat exchanger 70, the outdoor heat exchanger 13, and the pressure vessel 17 have substantially the same temperature. Therefore, the temperature of the refrigerant 40 enclosed in each component of the outdoor unit 10 also increases. Thus, the refrigerant 40 inside the pressure vessel 17 and the refrigerant 40 inside the portion where the fusible plug 60 is provided have substantially the same temperature and substantially the same pressure. Accordingly, when the temperature inside the pressure vessel 17 becomes equal to or higher than the melting temperature of the fusible portion 62, the fusible portion 62 melts, and the inside of the bypass refrigerant circuit 33 and the inside of the circulation refrigerant circuit 30 can be released to the atmospheric pressure. Therefore, it is possible to achieve the original purpose of protecting the pressure vessel 17 when the ambient temperature of the outdoor unit 10 increases abnormally.

As described above, according to Embodiment 1, by setting a location where the fusible plug 60 as the pressure release means is arranged between the branch portion 31 and the internal heat exchanger 70 in the bypass refrigerant circuit 33, malfunction of the fusible plug 60 can be suppressed. In other words, there is no need to provide a new component just to suppress malfunction of the fusible plug 60. Therefore, according to Embodiment 1, malfunction of the fusible plug 60 can be suppressed while suppressing an increase in the number of parts in the refrigeration cycle device 100.

In addition, by providing the bypass refrigerant circuit 33 and the internal heat exchanger 70, for example, during the heating operation, the specific entropy of the refrigerant 40 flowing into the outdoor heat exchanger 13 in the circulation refrigerant circuit 30 can be lowered by the refrigerant 40 flowing through the internal heat exchanger 70 in the bypass refrigerant circuit 33. As a result, a heat quantity that the refrigerant 40 can absorb in the outdoor heat exchanger 13 that functions as an evaporator during the heating operation can be increased, and an efficiency of the refrigeration cycle device 100 can be increased. Thus, in Embodiment 1, malfunction of the fusible plug 60 can be suppressed without adding new parts in the refrigeration cycle device 100 in which the bypass refrigerant circuit 33 and the internal heat exchanger 70 are provided to improve an efficiency.

Moreover, according to Embodiment 1, the pressure vessel 17 is provided between the compressor 12 and the evaporator in the circulation refrigerant circuit 30. Therefore, a part of the refrigerant 40 can be stored in the pressure vessel 17 when the amount of the refrigerant 40 is excessively large. As a result, it is possible to prevent an excess amount of the refrigerant 40 from flowing into the compressor 12. Further, as described above, when the pressure inside the pressure vessel 17 increases abnormally due to an increase in ambient temperature, the fusible portion 62 of the fusible plug 60 can melt to release the inside of the pressure vessel 17 to the atmospheric pressure, occurrence of failures such as rupture of the pressure vessel 17 can be suppressed. In Embodiment 1, the evaporator is the indoor heat exchanger 22 during the cooling operation and is the outdoor heat exchanger 13 during the heating operation.

Further, according to Embodiment 1, the fusible plug 60 as the pressure release means is located above the liquid surface S of the liquid refrigerant 40 stored in the pressure vessel 17 in the direction of gravity. Therefore, when the fusible portion 62 of the fusible plug 60 melts to release the inside of the circulation refrigerant circuit 30 and the inside of the bypass refrigerant circuit 33 to the atmospheric pressure, the pressure inside the pressure vessel 17 can be easily released.

Further, for example, when an electronic expansion valve or the like is provided in the refrigerant pipe 39 connecting the pressure vessel 17 and the fusible plug 60, and the electronic expansion valve remains closed due to a failure or breakage, a part of the refrigerant pipe 39 connecting the pressure vessel 17 and the fusible plug 60 remains blocked. In this state, even when the fusible portion 62 of the fusible plug 60 melts, the pressure inside the pressure vessel 17 may not be released to the atmospheric pressure.

In contrast, according to Embodiment 1, the refrigerant pipe 39 connecting the pressure vessel 17 and the fusible plug 60 which is the pressure release means is not provided with a valve member. Therefore, a part of the refrigerant pipe 39 connecting the pressure vessel 17 and the fusible plug 60 does not remain blocked by a valve member. Thus, it is possible to prevent a part of the refrigerant pipe 39 connecting the pressure vessel 17 and the fusible plug 60 from being blocked. Accordingly, when the fusible plug 60 is released to the atmospheric pressure, the inside of the pressure vessel 17 can be suitably released to the atmospheric pressure via the refrigerant pipe 39.

Further, for example, when a capillary is provided in the refrigerant pipe 39 connecting the pressure vessel 17 and the fusible plug 60, a part of the refrigerant pipe 39 becomes extremely narrow due to the capillary, and it becomes difficult to release the pressure from the pressure vessel 17 to the fusible plug 60 through the refrigerant pipe 39. Therefore, even when the fusible plug 60 is released to the atmospheric pressure, it may be difficult to suitably release the pressure inside the pressure vessel 17 to the atmospheric pressure.

In contrast, according to Embodiment 1, the refrigerant pipe 39 connecting the pressure vessel 17 and the fusible plug 60 which is the pressure release means is not provided with a capillary. Therefore, when the fusible plug 60 is released to the atmospheric pressure, the inside of the pressure vessel 17 can be released to the atmospheric pressure more suitably through the refrigerant pipe 39.

Further, according to Embodiment 1, the bypass refrigerant circuit 33 has the expansion valve 54 as the second pressure-reducing device between the branch portion 31 and the fusible plug 60 which is the pressure release means.

Therefore, the pressure of the refrigerant 40 can be reduced by the expansion valve 54 and the temperature of the refrigerant 40 can be reduced until the refrigerant 40 reaches the fusible plug 60 from the branch portion 31. Thus, when the refrigerant 40 flows normally during the cooling operation and the heating operation, the temperature of the refrigerant 40 reaching the fusible plug 60 can be more suitably restrained from becoming equal to or higher than the melting temperature of the fusible portion 62 of the fusible plug 60. Accordingly, malfunction of the fusible plug 60 can be further suppressed. Further, for example, since the expansion valve 54 is not provided in the refrigerant pipe 39 connecting the pressure vessel 17 and the fusible plug 60, a part of the refrigerant pipe 39 is not blocked by the expansion valve 54. Thus, when the fusible plug 60 is released to the atmospheric pressure, the inside of the pressure vessel 17 can be suitably released to the atmospheric pressure through the refrigerant pipe 39.

Further, according to Embodiment 1, the pressure release means is the fusible plug 60 having the fusible portion 62 that melts at a temperature equal to or higher than a predetermined value. Therefore, as described above, for example, when the ambient temperature of the fusible plug 60 increases due to a fire or the like, the fusible portion 62 melts so that the inside of the pressure vessel 17 can be easily released to the atmospheric pressure.

Further, according to Embodiment 1, the four-way valve 16 provided in the circulation refrigerant circuit 30 can switch the roles of the condenser and the evaporator. In Embodiment 1, by switching the four-way valve 16, it is possible to switch between a state in which the outdoor heat exchanger 13 functions as a condenser and the indoor heat exchanger 22 functions as an evaporator, and a state in which the outdoor heat exchanger 13 functions as an evaporator, and the indoor heat exchanger 22 functions as a condenser. Thus, the operation of the refrigeration cycle device 100 can be switched between the cooling operation and the heating operation. Further, by switching the four-way valve 16 during heating operation, the refrigeration cycle device 100 can be caused to perform a reverse cycle defrosting operation. In a case of performing such a reverse cycle defrosting operation, as described above, when the defrosting operation is started, the refrigerant 40 flowing as indicated by the arrow D shown in FIG. 1 easily reaches the fusible plug 60. Even in such a case, in Embodiment 1, malfunction of the fusible plug 60 can be suppressed as described above. In this way, the effect of suppressing malfunction of the fusible plug 60 described above can be obtained more usefully in the refrigeration cycle device 100 provided with the four-way valve 16 capable of switching the roles of the condenser and the evaporator.

Embodiment 2

Figure 7:
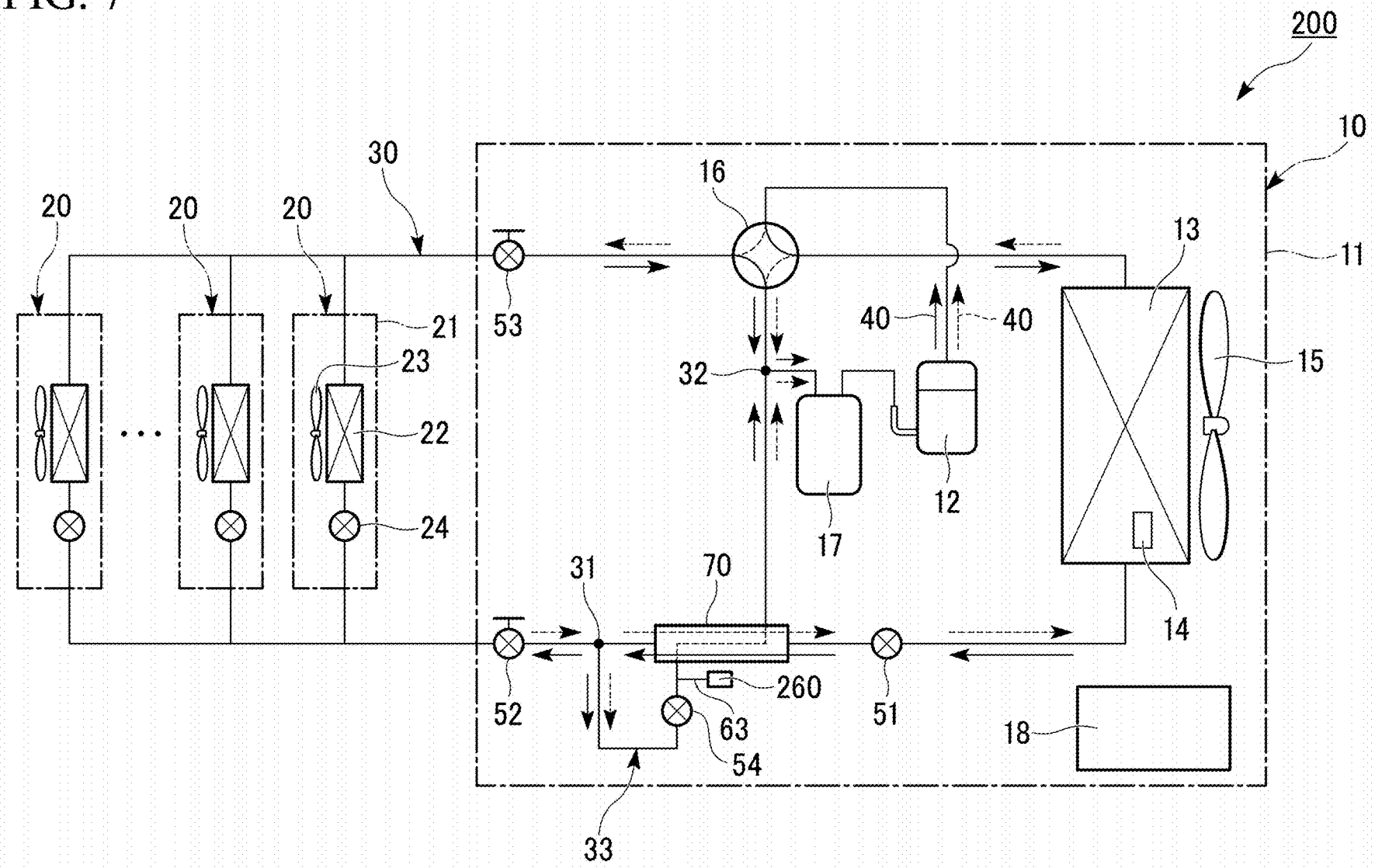
FIG. 7 is a refrigerant circuit diagram showing a schematic configuration of a refrigeration cycle device in Embodiment 2.

FIG. 7 is a refrigerant circuit diagram showing a schematic configuration of a refrigeration cycle device 200 in Embodiment 2. In the following description of Embodiment 2, the same configurations as those of Embodiment 1 described above will be denoted by the same reference signs and the description thereof will not be repeated as appropriate.

As shown in FIG. 7, the refrigeration cycle device 200 in Embodiment 2 includes a plurality of the indoor units 20. The plurality of indoor units 20 are each connected to one outdoor unit 10. The refrigeration cycle device 200 in Embodiment 2 is a multi-type air conditioner.

In the refrigeration cycle device 200 of Embodiment 2, the pressure release means is a rupture plate 260 that ruptures when a pressure equal to or higher than a predetermined value is applied. The rupture plate 260 is, for example, a metal thin plate. When the pressure of the refrigerant 40 in a portion where the rupture plate 260 is provided in the bypass refrigerant circuit 33 becomes equal to or greater than a predetermined value, the rupture plate 260 ruptures to release the inside of the bypass refrigerant circuit 33 and the inside of the circulation refrigerant circuit 30 to the atmospheric pressure. The pressure value at which the rupture plate 260 ruptures is set to, for example, a maximum saturation pressure of the refrigerant 40 or less. As an example, when R410A is used as the refrigerant 40, since a maximum saturation pressure of R410A is about 4.9 MPa, the pressure value at which the rupture plate 260 ruptures is set to 4.5 MPa which is lower than 4.9 MPa.

During the cooling operation, the state of the refrigerant 40 flowing through the portion where the rupture plate 260 is provided in the bypass refrigerant circuit 33 is indicated by the point Pf in FIG. 5. During the heating operation, the state of the refrigerant 40 flowing through the portion where the rupture plate 260 is provided in the bypass refrigerant circuit 33 is indicated by the point Po in FIG. 6. In other words, both during the cooling operation and during the heating operation, the pressure of the refrigerant 40 flowing through the portion where the rupture plate 260 is provided in the bypass refrigerant circuit 33 is relatively low. Therefore, the pressure of the refrigerant 40 flowing through the portion where the rupture plate 260 is provided in the bypass refrigerant circuit 33 is restrained from becoming equal to or higher than the pressure at which the rupture plate 260 ruptures, and malfunction of the rupture plate 260 is suppressed.

Further, when the defrosting operation is started, even if the refrigerant 40 flows into the bypass refrigerant circuit 33 as indicated by the arrow D in FIG. 1, the refrigerant 40 passes through the internal heat exchanger 70 until the refrigerant 40 reaches the rupture plate 260. Therefore, the temperature of the refrigerant 40 is lowered by heat exchange in the internal heat exchanger 70, and the pressure of the refrigerant 40 is also lowered. Thus, even when the defrosting operation is started, the pressure of the refrigerant 40 reaching the rupture plate 260 can be restrained from becoming equal to or higher than the pressure at which the rupture plate 260 ruptures. Accordingly, malfunction of the rupture plate 260 is suppressed.

The other configurations in the refrigeration cycle device 200 are the same as the other configurations in the refrigeration cycle device 100 of Embodiment 1. The pressure release means in Embodiment 2 may be a fusible plug as in Embodiment 1.

Embodiment 3

Figure 8:
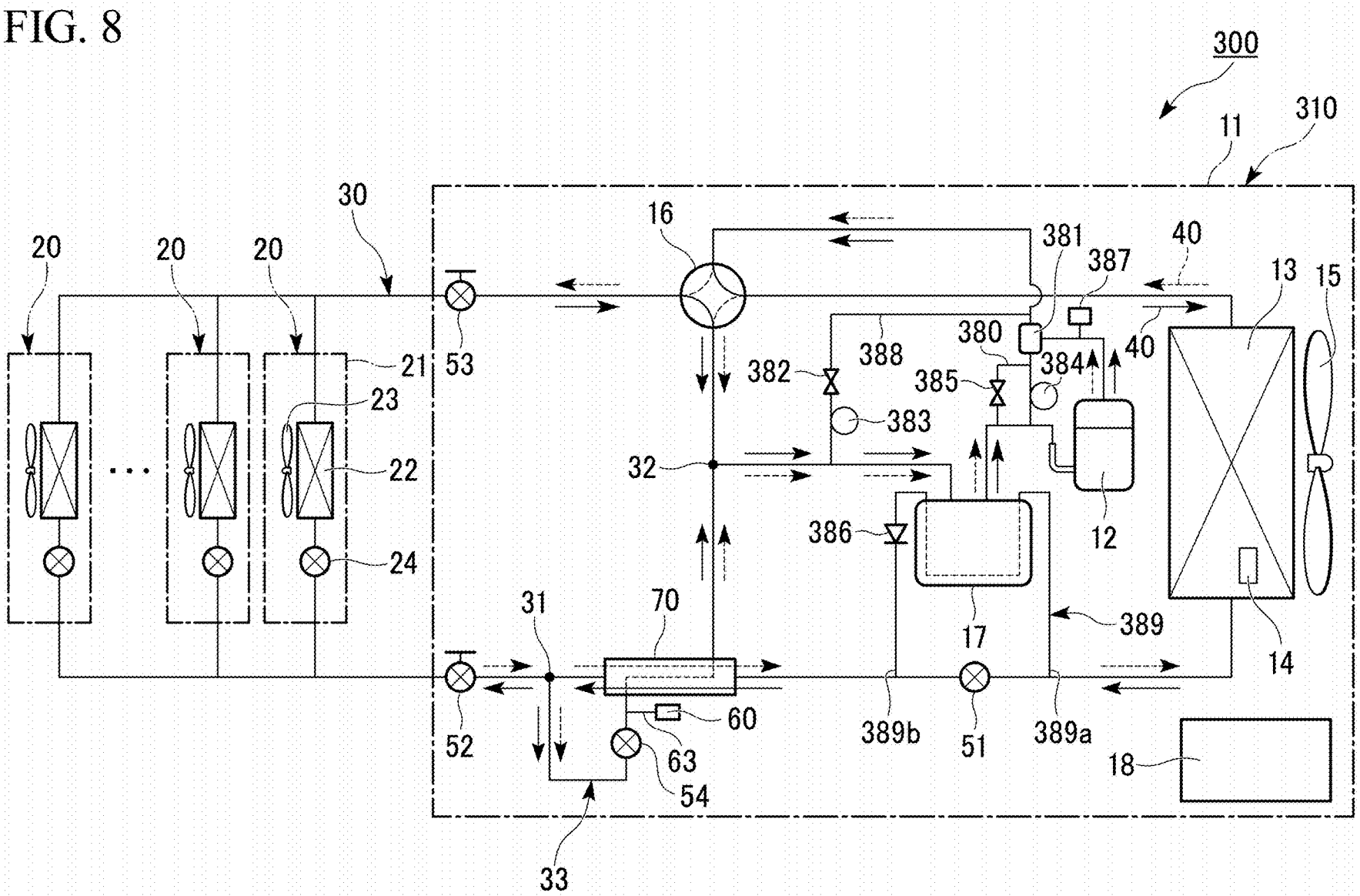
FIG. 8 is a refrigerant circuit diagram showing a schematic configuration of a refrigeration cycle device in Embodiment 3.

FIG. 8 is a refrigerant circuit diagram showing a schematic configuration of a refrigeration cycle device 300 in Embodiment 3. In the following description of Embodiment 3, the same configurations as those of Embodiment 1 and Embodiment 2 described above will be denoted by the same reference signs, and the description thereof will not be repeated as appropriate.

The pressure release means in Embodiment 3 is the fusible plug 60 as in Embodiment 1, unlike Embodiment 2. The pressure means in Embodiment 3 may be a rupture plate as in Embodiment 2. The refrigeration cycle device 300 of Embodiment 3 includes an oil separator 381, a pressure sensor 387, a heat exchange circuit 389, an oil return circuit 380, and a pressure regulation circuit 388, in addition to the configuration of the refrigeration cycle device 200 of Embodiment 2. The oil separator 381, the pressure sensor 387, the heat exchange circuit 389, the oil return circuit 380, and the pressure regulation circuit 388 are provided in an outdoor unit 310.

A first end portion 389*a* of the heat exchange circuit 389 is connected to a portion between the outdoor heat exchanger 13 and the outdoor expansion valve 51 in the circulation refrigerant circuit 30. A second end portion 389*b* of the heat exchange circuit 389 is connected to a portion between the outdoor expansion valve 51 and the internal heat exchanger 70 in the circulation refrigerant circuit 30. That is, the heat exchange circuit 389 connects the portion between the outdoor heat exchanger 13 and the outdoor expansion valve 51 in the circulation refrigerant circuit 30 and the portion between the outdoor expansion valve 51 and the internal heat exchanger 70 in the circulation refrigerant circuit 30. The heat exchange circuit 389 passes through the inside of the pressure vessel 17.

A check valve 386 is provided in the heat exchange circuit 389. The check valve 386 allows the flow of the refrigerant 40 from the first end portion 389*a* toward the second end portion 389*b* in the flow of the refrigerant 40 inside the heat exchange circuit 389. On the other hand, the check valve 386 blocks the flow of the refrigerant 40 from the second end portion 389*b* toward the first end portion 389*a* in the flow of the refrigerant 40 inside the heat exchange circuit 389. Therefore, inside the heat exchange circuit 389, the refrigerant 40 flows during the cooling operation but the refrigerant 40 does not flow during the heating operation.

During the cooling operation of Embodiment 3, the outdoor expansion valve 51 is in a fully closed state, so that the refrigerant 40 can hardly pass through the outdoor expansion valve 51. Thus, during the cooling operation, almost all of the high-pressure liquid refrigerant 40 that has flowed out of the outdoor heat exchanger 13 flows inside the heat exchange circuit 389. The refrigerant 40 flowing inside the heat exchange circuit 389 exchanges heat with the low-temperature liquid refrigerant 40 stored in the pressure vessel 17 when passing through the pressure vessel 17.

The oil separator 381 separates the gaseous refrigerant 40 discharged from the compressor 12 and an oil for protecting the compressor 12 which is discharged by being mixed with the discharged gaseous refrigerant 40. The oil separator 381 causes the separated gaseous refrigerant 40 to flow to the four-way valve 16 and to return the separated oil to the suction side of the compressor 12.

The oil return circuit 380 is a circuit that connects to the suction side of the compressor 12 to return the oil returned from the oil separator 381 to the suction side of the compressor 12. The oil return circuit 380 has a capillary 384 and an on-off valve 385. The control device 18 performs control to open the on-off valve 385 when it is desired to return a large amount of the oil to the compressor 12, such as when the operation of the compressor 12 is started.

The pressure regulation circuit 388 is a circuit that branches from a discharge port of the oil separator 381 through which the gaseous refrigerant 40 is discharged and merges with the circulation refrigerant circuit 30 at an inflow port of the refrigerant 40 in the pressure vessel 17. The pressure regulation circuit 388 has an on-off valve 382 and a capillary 383. During a normal operation, the on-off valve 382 is in a fully closed state, that is, a state in which the refrigerant 40 can hardly pass through, and the refrigerant 40 does not pass through the pressure regulation circuit 388. On the other hand, for example, during the heating operation, when the control device 18 detects an abnormal increase in the pressure of the refrigerant 40 discharged from the compressor 12 due to a failure of the indoor fan 23 or the like based on the pressure sensor 387, the control device 18 opens the on-off valve 382. Thus, a part of the refrigerant 40 discharged from the compressor 12 flows inside the pressure regulation circuit 388 and flows into the inflow port of the refrigerant 40 in the pressure vessel 17. Therefore, the pressure of the refrigerant 40 discharged from the compressor 12 can be reduced. In this way, by regulating a degree of opening of the on-off valve 382, the pressure of the refrigerant 40 discharged from the compressor 12 can be regulated by the pressure regulation circuit 388.

In Embodiment 3, when the operation of the refrigeration cycle device 300 is stopped, the control device 18 may perform pressure equalization control of opening at least one of the on-off valve 385 and the on-off valve 382 to make a relatively low pressure of the refrigerant 40 before being sucked into the compressor 12 the same as a relatively high pressure of the refrigerant 40 discharged from the compressor 12.

When the on-off valve 382 is opened during the pressure equalization control described above, the high-pressure gaseous refrigerant 40 after being discharged from the compressor 12 flows through the pressure regulation circuit 388 to return to a portion between the merging portion 32 and the pressure vessel 17 in the circulation refrigerant circuit 30. At this time, the refrigerant 40 returned from the pressure regulation circuit 388 may flow toward the four-way valve 16, the pressure vessel 17, and the internal heat exchanger 70 of the bypass refrigerant circuit 33. In this case, since the temperature of the refrigerant 40 discharged from the compressor 12 is, for example, about 100° C., the temperature of the refrigerant 40 between the internal heat exchanger 70 and the pressure vessel 17 and between the four-way valve 16 and the pressure vessel 17 may be about 73° C. or higher and 80° C. or lower.

Further, when the on-off valve 385 is opened during the pressure equalization control described above, the high-pressure gaseous refrigerant 40 after being discharged from the compressor 12 flows through the oil return circuit 380 to return to the discharge side of the compressor 12. At this time, refrigerant 40 returned from the oil return circuit 380 may flow toward the compressor 12 and the pressure vessel 17. In this case, since the temperature of the refrigerant 40 discharged from the compressor 12 is, for example, about 100° C., the temperature of the refrigerant 40 between the compressor 12 and the pressure vessel 17 may be about 73° C. or higher and 80° C. or lower.

As described above, during the pressure equalization control, the temperature of the refrigerant 40 between the four-way valve 16, the internal heat exchanger 70, and the compressor 12 may be equal to or higher than the melting temperature of the fusible portion 62 of the fusible plug 60. Therefore, when the fusible plug 60 is arranged between the four-way valve 16, the internal heat exchanger 70, and the compressor 12, the fusible plug 60 may malfunction even though there is no concern that the pressure vessel 17 may rupture, during the pressure equalization control.

In contrast, according to Embodiment 3, the fusible plug 60 is provided between the branch portion 31 and the internal heat exchanger 70 in the bypass refrigerant circuit 33 as in Embodiment 1. Therefore, the refrigerant 40 returned from the pressure regulation circuit 388 and the oil return circuit 380 passes through the internal heat exchanger 70 before reaching the fusible plug 60. As a result, the temperature of the refrigerant 40 reaching the fusible plug 60 can be lowered by heat exchange in the internal heat exchanger 70. Therefore, it is possible to suppress melting of the fusible portion 62 and suppress malfunction of the fusible plug 60 during the pressure equalization control.

Further, even when the compressor 12 unexpectedly stops such as during a power failure, the high-temperature gaseous refrigerant 40 flows between the internal heat exchanger 70 and the pressure vessel 17, between the four-way valve 16 and the pressure vessel 17, and between the compressor 12 and the pressure vessel 17. Even in this case, since the temperature of the refrigerant 40 decreases due to heat exchange in internal heat exchanger 70 until the refrigerant 40 reaches the fusible plug 60, malfunction of the fusible plug 60 can be suppressed.

The other configurations in the refrigeration cycle device 300 are the same as the other configurations in the refrigeration cycle device 200 of Embodiment 2.

Although the embodiments of the present disclosure have been described above, the present disclosure is not limited to the configurations of the embodiments described above, and the following configurations and methods can also be adopted. The pressure release means may be a configuration other than the fusible plug and the rupture plate described above. A plurality of pressure release means may be provided. The pressure vessel may have any structure and may be other than the accumulator. The pressure vessel may not be provided.

The first refrigerant circuit (circulation refrigerant circuit 30) only requires that the compressor, the condenser, the internal heat exchanger, the first pressure-reducing device, and the evaporator are annularly connected. The first pressure-reducing device and the second pressure-reducing device may be pressure-reducing devices having any structure as long as they can reduce the pressure of the refrigerant. For example, in each embodiment described above, only one of the indoor expansion valve 24 and the outdoor expansion valve 51 provided as the first pressure-reducing device may be provided. The second pressure-reducing device may not be provided. The four-way valve may not be provided.

The refrigeration cycle device may be any device that utilizes a refrigeration cycle in which a refrigerant circulates and is not limited to an air conditioner. The refrigeration cycle device may be a water heater or the like. As described above, each configuration and each method described in this specification can be appropriately combined as long as they do not contradict each other.

The invention claimed is:

1. A refrigeration cycle device comprising:

a first refrigerant circuit in which a compressor, a condenser, an internal heat exchanger, a first pressure-reducing device, and an evaporator are annularly connected;

a second refrigerant circuit configured to branch from a branch portion of the first refrigerant circuit and merge with a merging portion of the first refrigerant circuit on a suction side of the compressor via the internal heat exchanger; and a pressure releaser provided between the branch portion and the internal heat exchanger in the second refrigerant circuit, wherein the pressure releaser is configured to release refrigerant to an atmosphere adjacent to the refrigeration cycle device in response to a physical parameter of refrigerant passing through the second refrigerant circuit reaching a threshold value.

2. The refrigeration cycle device according to claim 1, further comprising:

a pressure vessel provided between the compressor and the evaporator in the first refrigerant circuit.

3. The refrigeration cycle device according to claim 2, wherein the pressure releaser is located above a liquid surface of a liquid the refrigerant in liquid form when it is stored in the pressure vessel in a direction of gravity.

4. The refrigeration cycle device according to claim 2, wherein a refrigerant pipe configured to connect the pressure vessel and the pressure releaser is not provided with a valve member.

5. The refrigeration cycle device according to claim 2, wherein a refrigerant pipe configured to connect the pressure vessel and the pressure releaser is not provided with a capillary.

6. The refrigeration cycle device according to claim 1, wherein the second refrigerant circuit includes a second pressure-reducing device between the branch portion and the pressure releaser.

7. The refrigeration cycle device according to claim 1, wherein the pressure releaser is a fusible plug including a fusible portion configured to melt at a temperature equal to or higher than a predetermined value.

8. The refrigeration cycle device according to claim 1, wherein the pressure releaser is a rupture plate configured to rupture when a pressure equal to or greater than a predetermined value is applied.

9. The refrigeration cycle device according to claim 1, further comprising:

a four-way valve provided in the first refrigerant circuit, wherein the four-way valve is configured to switch roles of the condenser and the evaporator.

10. The refrigeration cycle device according to claim 1, wherein the physical parameter of the refrigerant is one of pressure or temperature.

* * * * *